US006123520A

United States Patent [19]

Moore, Jr.

[11] Patent Number: 6,123,520

[45] Date of Patent: Sep. 26, 2000

[54] COMPRESSOR UPPER SHELL WELD RING

[75] Inventor: Billy W. Moore, Jr., Hot Springs, Ark.

[73] Assignee: Carrier Corporation, Farmington, Conn.

[21] Appl. No.: 09/115,817

[22] Filed: Jul. 15, 1998

[51] Int. Cl.[7] ..... A21B 1/00; A21B 1/22; F27D 11/00

[52] U.S. Cl. ..... 417/410.3; 417/410

[58] Field of Search ..... 417/410, 553, 417/572, 552, 410 R, 410.3; 418/55.1

[56] References Cited

U.S. PATENT DOCUMENTS

| | | | |
|---|---|---|---|
| 3,887,304 | 6/1975 | Otaki et al. | 417/363 |
| 4,730,994 | 3/1988 | Maertens | 417/572 |
| 5,055,010 | 10/1991 | Logan | 417/410 |
| 5,141,420 | 8/1992 | Nambiar | 418/55.1 |
| 5,267,844 | 12/1993 | Grassbaugh et al. | 417/410 R |
| 5,445,507 | 8/1995 | Nakamura et al. | 418/55.1 |
| 5,980,222 | 11/1999 | Fry | 417/553 |

*Primary Examiner*—Mark Paschall
*Assistant Examiner*—Leonid Fastovsky
*Attorney, Agent, or Firm*—Carlson, Gasker & Olds

[57] ABSTRACT

The present invention relates to a weld ring for aiding in securing parts of an outer shell of a compressor to each other and a method for utilizing the same. The weld ring is comprised of a upper ring and a lower ring. The upper ring inserts into a rim of an upper shell assembly of the compressor. The lower ring inserts into a center shell assembly of the compressor. The weld ring aligns the upper shell assembly relative to the center shell assembly. The upper shell assembly, center shell assembly, and weld ring are secured to each other. Preferably, the upper shell assembly, center shell assembly, and weld ring are secured to each other by a welded joint.

20 Claims, 3 Drawing Sheets

COMPRESSOR UPPER SHELL WELD RING

BACKGROUND OF THE INVENTION

This invention relates generally to compressors and, more particularly, to a weld ring for a compressor.

A typical sealed compressor includes an outer shell having several parts. The parts of the outer shell must be connected to each other along seams between them in a secure and fluid tight manner. In addition, a compressor usually includes several compartments that must remain sealed from each other and the environment for the compressor to function properly. The parts of the outer shell usually include an upper shell assembly, a cylindrical center shell assembly, and a lower shell assembly. It is also necessary to precisely align the parts of the outer shell to allow for fluid tight seams between the parts and the compressor compartments.

In the prior art, the seams are usually connected to each other by a welded joint. Several problems exist with the current methods for welding such seams. First, the upper shell assembly usually includes a rim that is secured to the center shell assembly and this rim often does not have a circular inner circumference. Thus, aligning the upper shell assembly relative to the center shell assembly is difficult. Second, the current method does not always provide a reliable way for maintaining the center shell assembly in position relative to the upper shell assembly while the seam between them is being secured. Third, when the seams are secured by a welded joint, often the weld material spatters through the seam contaminating the inside of the compressor.

Thus, it is desirable to provide a method and apparatus for aligning parts of a compressor outer shell relative to each other. It is also desirable to provide a method and apparatus that will maintain parts of a compressor outer shell in position relative to each other while the seam between the parts is being secured. It is furthermore desirable to provide a method and apparatus that prevents contamination of a compressor by weld material when the seams between compressor shell parts are being secured.

SUMMARY OF THE INVENTION

In general terms, this invention provides a method and apparatus that aligns an upper shell assembly relative to a center shell assembly and maintains them in position relative to each other while a seam between them is secured. In addition, the present invention provides a method and apparatus that prevents contamination of a compressor by weld material while a seam between parts of the compressor outer shell are being secured to each other.

In a preferred embodiment, the present invention comprises a sealed compressor having an upper shell assembly, a center shell assembly, and a lower shell assembly. The upper shell assembly includes a rim. The apparatus further includes a weld ring having a lower ring and an upper ring, which has a circular outer circumference. The upper ring inserts inside the rim and the lower ring inserts inside the center shell assembly. The upper shell assembly, center shell assembly, and weld ring are secured to each other. Preferably, insertion of the upper ring into the rim conforms an inner circumference of the rim to the circular outer circumference of the upper ring. Preferably, the center shell assembly, weld ring, and upper shell assembly are secured to each other by a welded joint.

The method of the present invention comprises the steps of providing a compressor having an upper shell assembly, a center shell assembly and a lower shell assembly. In addition, a weld ring is provided having an upper ring and a lower ring, with the upper ring having a circular outer circumference. The upper ring is inserted into a rim of the upper shell assembly. The center shell assembly is inserted around the lower ring. The weld ring, upper shell assembly, and the center shell assembly are secured to each other. Preferably, inserting the upper ring into the rim of the upper shell assembly conforms the shape of an inner circumference of the rim to the shape of the outer circumference of the upper ring and creates an interference fit between the upper ring and the rim. Preferably, the upper shell assembly, center shell assembly, and weld ring are secured to each other by welding them together.

These and other features and advantages of this invention will become more apparent to those skilled in the art from the following detailed description of the presently preferred embodiment. The drawings that accompany the detailed description can be described as follows.

DETAILED DESCRIPTION OF THE PREFERRED EMBODIMENT

Figure 1:
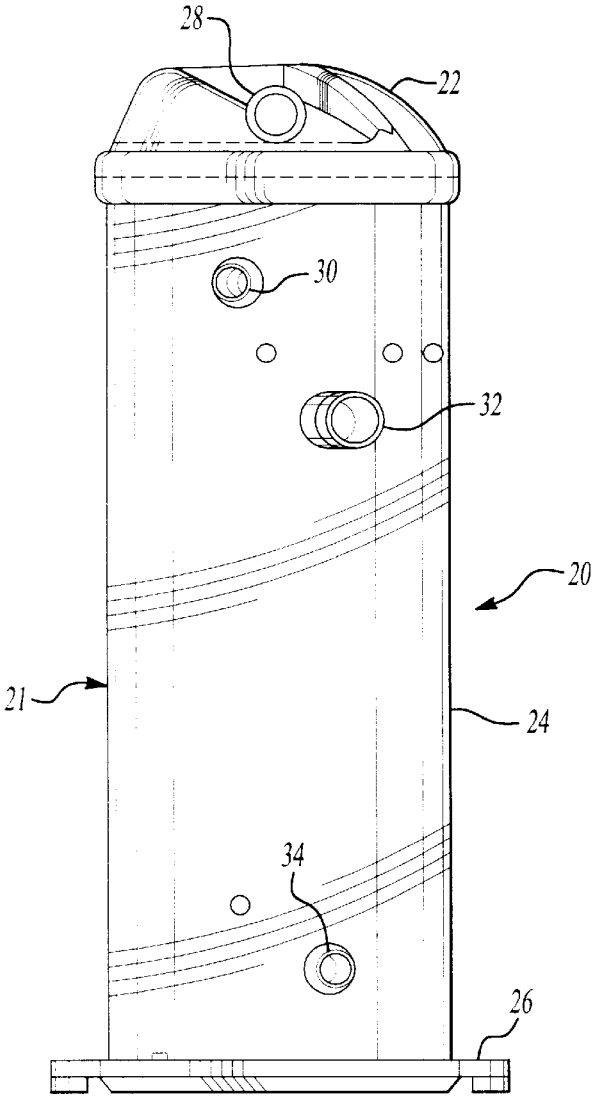
FIG. 1 is a side perspective view of a compressor designed according the present invention.

A side perspective view of a compressor is generally shown at 20 in FIG. 1. Compressor 20 includes an outer shell 21 comprised of an upper shell assembly 22, a center shell assembly 24, and a lower shell assembly 26. Preferably, outer shell assembly 24 has a generally cylindrical shape. Compressor 20 further includes a discharge fitting 28, an economizer fitting 30, a suction fitting 32, and an oil drain fitting 34. Preferably, the upper shell assembly 22 is formed from pickled hot rolled steel as is known in the art. Center shell assembly 24 preferably is formed from either pickled, hot rolled steel or pickled, cold rolled steel as is known in the art.

Figure 2:
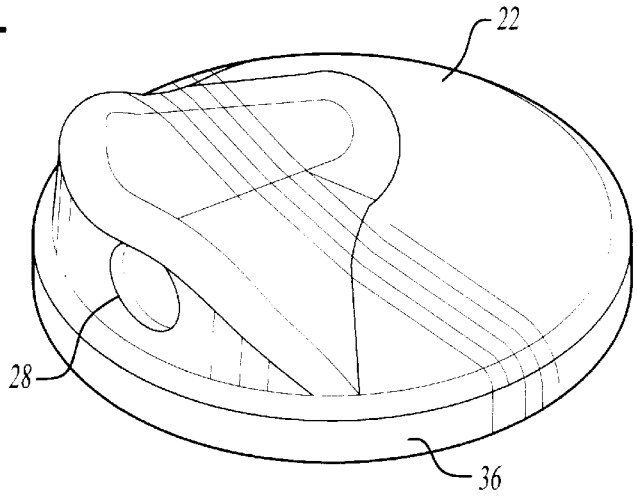
FIG. 2 is a top perspective view of an upper shell assembly shown in FIG. 1.
Figure 3:
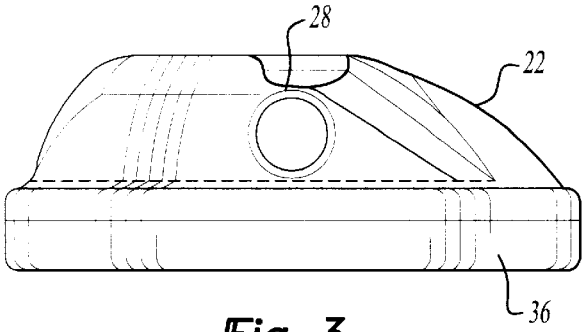
FIG. 3 is a side perspective view of the upper shell assembly shown in FIG. 2.

FIG. 2 is a top perspective view of upper shell assembly 22 and FIG. 3 is a side perspective view of upper shell assembly 22 as shown in FIG. 1. Upper shell assembly 22 includes a rim 36. Rim 36 has an inner circumference 49 (see FIG. 7) that may have a non-circular shape. The non-circular shape is in part due to manufacturing of the upper shell assembly 22.

Figure 4:
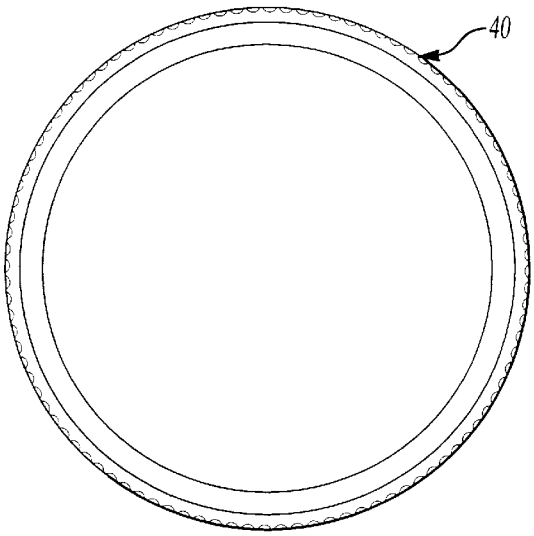
FIG. 4 is top plan view of a weld ring designed according to the present invention.
Figure 5:
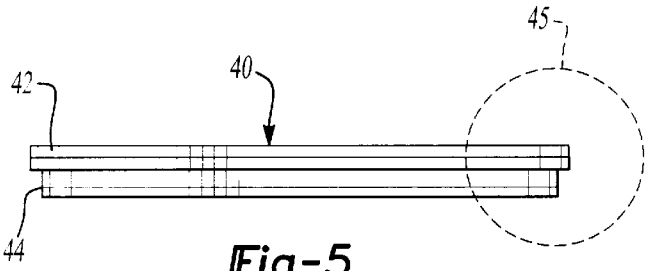
FIG. 5 is a side view of the weld ring shown in FIG. 4.
Figure 6:
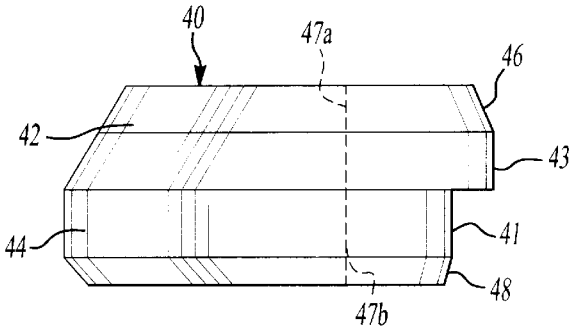
FIG. 6 is an enlarged view of the region circled in phantom in FIG. 5.

A top plan view of a weld ring is shown generally at 40 in FIG. 4. Weld ring 40 includes an upper ring 42 and a lower ring 44, shown in a side view in FIG. 5. FIG. 6 represents an enlargement of phantom circle 45 of FIG. 5. As shown in FIG. 6, upper ring 42 has an outer circumference 43 and a beveled edge 46. Upper ring 42 also includes an inner surface 47*a*. Lower ring 44 has an outer circumference 41 and a beveled edge 48. Lower ring 44 further includes an inner circumference 47*b*. Inner circumference 47*a* has a diameter that is the same as a diameter of inner circumference 47*b*. The outer circumference 43 of upper ring 42 has a diameter that is larger than outer circumference 41 of lower ring 44. The diameter of outer circumference 43 is nearly identical to the diameter of inner circumference 49 of upper shell assembly 22. The diameter of outer circumference 41 of lower ring 44 is less than an inner diameter of center shell assembly 24. Weld ring 40 is of an unitary design with upper ring 42 being integral with lower ring 44. Preferably, weld ring 40 is formed from pickled, hot rolled steel.

Figure 7:
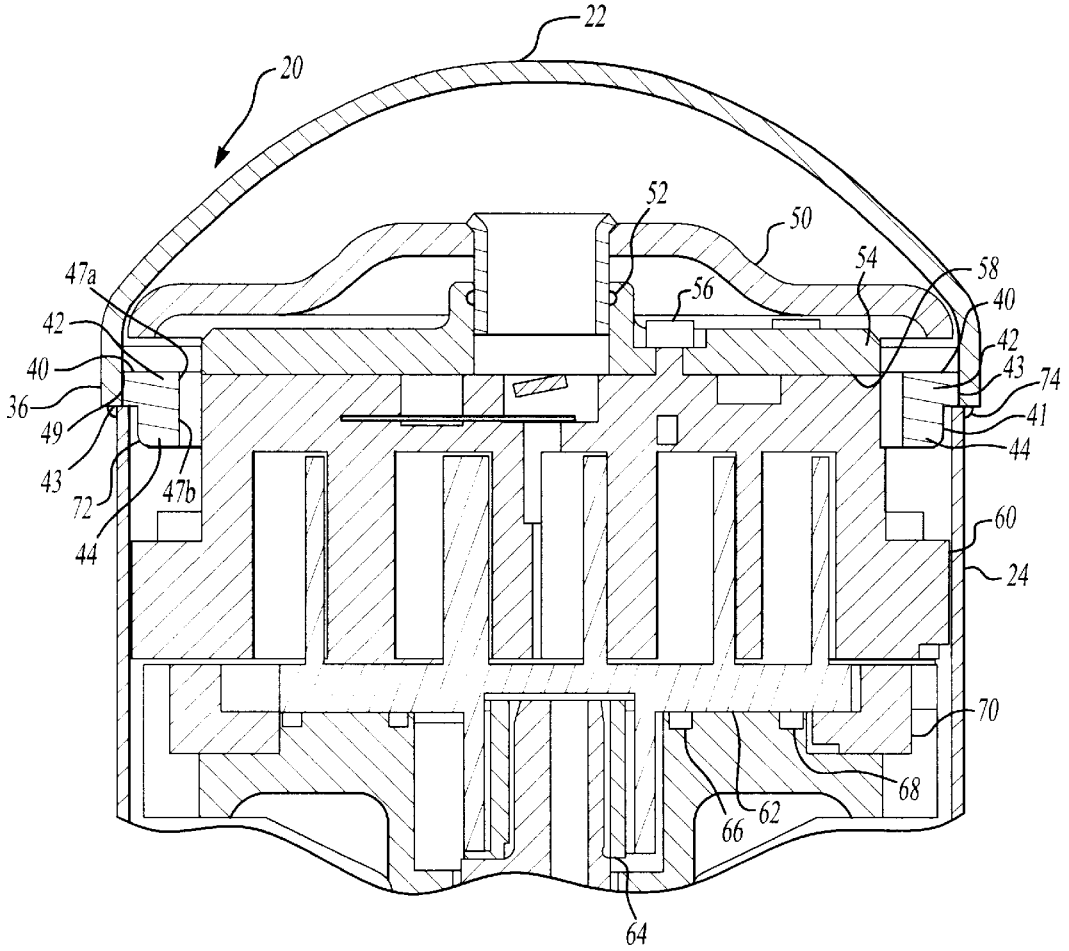
FIG. 7 is a partial cross-sectional view of the compressor shown in FIG. 1 incorporating the weld ring.

In FIG. 7, a partial cross-sectional view of compressor 20 incorporating weld ring 40 is shown. Compressor 20 includes a separator plate assembly 50 and an O-ring 52. Compressor 20 further includes a discharge cover 54, a cap screw 56 and a gasket 58. Preferably, compressor 20 is a scroll compressor as is known in the art. Alternatively, compressor 20 may comprise any other sealed compressor. Compressor 20 includes a non-orbiting scroll 60, an orbiting scroll assembly 62, and a slider block 64. An inner seal 66 and outer seal 68 are adjacent orbiting scroll assembly 62. A coupling 70 is adjacent orbiting scroll assembly 62.

Preferably, upper ring 42 conforms inner circumference 49 to the circular shape of outer circumference 43. Preferably, an interference fit is created between upper ring 42 and rim 36. A gap 72 is formed between center shell assembly 24 and outer circumference 41 of lower ring 44. The size of gap 72 is determined by the difference between the diameter of outer circumference 41 and the inner diameter of center shell assembly 24. A welded joint 74 secures upper shell assembly 22, center shell assembly 24, and weld ring 40 to each other. When welded joint 74 is formed, the fusion fuses upper shell assembly 22, center shell assembly 24, and weld ring 40 together in the region where they contact. Weld ring 40, when inserted into upper shell assembly 22 and center shell assembly 24, acts as a mechanical barrier to prevent any weld material from contaminating the interior of shell 21 of the compressor 20.

Beveled edges 46 and 48 aid in inserting upper ring 42 into upper shell assembly 22 and lower ring 44 into center shell assembly 24. Weld ring 40 holds upper shell assembly 22 in alignment with center shell assembly 24 while weld joint 74 is being created. Gap 72 aids in fitting center shell assembly 24 around lower ring 44.

The method of the present invention comprises the steps of providing the internal components of compressor 20 including weld ring 40. Then, inserting upper ring 42 into upper shell assembly 22 and inserting center shell assembly 24 around lower ring 44. Then, creating welded joint 74 to secure upper shell assembly 22, center shell assembly 24, and weld ring 40 to each other.

The present invention has been described in accordance with the relevant legal standards, thus the foregoing description is exemplary rather than limiting in nature. Variations and modifications to the disclosed embodiment may become apparent to those skilled in the art and do come within the scope of this invention. Accordingly, the scope of legal protection afforded this invention can only be determined by studying the following claims.

What is claimed is:

1. A compressor comprising:

a sealed compressor having an upper shell assembly, a center shell assembly, and a lower shell assembly;

said upper shell assembly having a rim;

a weld ring including an upper ring and a lower ring, said upper ring having a circular outer circumference;

said upper ring inserted inside said rim and said lower ring inserted inside said center shell assembly; and said upper shell assembly, said center shell assembly, and said weld ring secured together, a weld joint contacting and securing said upper shell assembly to said center shell assembly, and said weld joint contacting both said upper shell assembly and said center shell assembly.

2. A compressor as recited in claim 1 wherein said inner circumference conforming to said outer circumference of said upper ring when said upper ring is inserted inside said rim.

3. A compressor as recited in claim 1 wherein said upper shell assembly, said center shell assembly, and said weld ring are secured together by a welded joint.

4. A compressor as recited in claim 1 further comprising a gap located between said lower ring and said center shell assembly.

5. A compressor as recited in claim 1 wherein said upper ring includes a beveled edge.

6. A compressor as recited in claim 1 wherein said lower ring includes a beveled edge.

7. A compressor as recited in claim 1 wherein said sealed compressor is a scroll compressor.

8. A compressor as recited in claim 1 wherein said outer circumference of said upper ring has a diameter that is larger than a diameter of an outer circumference of said lower ring.

9. A compressor as recited in claim 8 wherein an inner surface of said upper ring has a diameter that is substantially the same as a diameter of an inner surface of said lower ring.

10. A compressor comprising:

a sealed compressor having an upper shell assembly, a center shell assembly, and a lower shell assembly;

said upper shell assembly having a rim;

a weld ring including an upper ring and a lower ring, said upper ring having a circular outer circumference;

said upper ring inserted inside said rim and said lower ring inserted inside said center shell assembly;

said inner circumference of said rim conforming to said outer circumference of said upper ring when said upper ring is inserted inside said rim; and said upper shell assembly, said center shell assembly, and said weld ring secured together, a weld joint contacting and securing said upper shell assembly to said center shell assembly, and said weld joint contacting both said upper shell assembly and said center shell assembly.

11. A compressor as recited in claim 10 wherein said upper shell assembly, said center shell assembly, and said weld ring are secured together by a welded joint.

12. A compressor as recited in claim 10 further comprising a gap, said gap located between said lower ring and said center shell assembly.

13. A compressor as recited in claim 10 wherein said sealed compressor is a scroll compressor.

14. A compressor as recited in claim 10 wherein said outer circumference of said upper ring has a diameter that is larger than a diameter of an outer circumference of said lower ring.

15. A method for assembly of a sealed compressor comprising the steps of:

a.) providing a compressor having an upper shell assembly, a center shell assembly, and a lower shell assembly;

b.) providing a weld ring having an upper ring and a lower ring, the upper ring having a circular outer circumference;

c.) inserting the upper ring into a rim of the upper shell assembly;

d.) inserting the center shell assembly around the lower ring; and securing the weld ring, the upper shell assembly, and the center shell assembly to each other, said securing step including providing a weld joint, said weld joint contacting both said upper shell assembly and said center shell assembly to secure said upper shell assembly and said center shell assembly to each other.

16. A method as recited in claim 15 wherein step a.) comprises providing a scroll compressor having an upper shell assembly, a center shell assembly, and a lower shell assembly.

17. A method as recited in claim 15 wherein step b.) comprises providing a beveled edge on each of the upper ring and the lower ring, the beveled edges aiding in assembly of the weld ring to the upper shell assembly and to the center shell assembly.

18. A method as recited in claim 15 wherein step c.) comprises inserting the upper ring into the rim of the upper shell assembly to thereby conform the shape of the inner circumference of the rim to the shape of the outer circumference of the upper ring and to create an interference fit between the upper ring and the rim.

19. A method as recited in claim 15 wherein step d.) comprises spacing the lower ring apart from the center shell assembly.

20. A method as recited in claim 15 wherein step e.) comprises welding the upper shell assembly, the center shell assembly, and the weld ring to each other.

* * * * *